US007377617B2

(12) United States Patent
Clarke et al.

(10) Patent No.: US 7,377,617 B2
(45) Date of Patent: May 27, 2008

(54) PRINTING APPARATUS AND METHOD

(76) Inventors: Leo C. Clarke, 1750 Whitecliff Dr., Albany, OR (US) 97321; Douglas C. Snell, 1765 Whitecliff Dr., Albany, OR (US) 97321; Makarand P. Gore, 1210 NE. Conroy Pl., Corvallis, OR (US) 97330

( * ) Notice: Subject to any disclaimer, the term of this patent is extended or adjusted under 35 U.S.C. 154(b) by 380 days.

(21) Appl. No.: 10/963,267

(22) Filed: Oct. 12, 2004

(65) Prior Publication Data

US 2006/0077224 A1 Apr. 13, 2006

(51) Int. Cl.
*B41J 23/00* (2006.01)

(52) U.S. Cl. ..... 347/37; 347/38

(58) Field of Classification Search ..... 347/37, 347/38, 19, 20

See application file for complete search history.

(56) References Cited

U.S. PATENT DOCUMENTS

| | | | | |
|---|---|---|---|---|
| 3,854,563 | A | 12/1974 | Cowardin et al. | |
| 4,699,684 | A | 10/1987 | Osborne | |
| 5,181,081 | A | 1/1993 | Suhan | |
| 5,291,355 | A | 3/1994 | Hatch et al. | |
| 5,296,981 | A | 3/1994 | Ogawa | |
| 5,305,169 | A | 4/1994 | Anderson et al. | |
| 5,316,464 | A | 5/1994 | Lexell | |
| 5,518,325 | A | 5/1996 | Kahle | |
| 5,541,900 | A | 7/1996 | Ito et al. | |
| 5,543,382 | A | 8/1996 | Watanabe et al. | |
| 5,684,762 | A | 11/1997 | Kubo | |
| 5,781,221 | A | 7/1998 | Wen et al. | |
| 5,841,610 | A | 11/1998 | Battu et al. | |
| 5,915,858 | A | 6/1999 | Wen | |
| 6,022,648 | A | 2/2000 | Jacobson et al. | |
| 6,074,031 | A | 6/2000 | Kahle | |
| 6,202,550 | B1 * | 3/2001 | Lee et al. | 101/38.1 |
| 6,251,571 | B1 | 6/2001 | Dessauer et al. | |
| 6,270,176 | B1 | 8/2001 | Kahle | |
| 6,310,691 | B2 | 10/2001 | Cariffe | |
| 6,336,756 | B1 | 1/2002 | Toyama et al. | |
| 6,386,667 | B1 | 5/2002 | Cariffe | |
| 2002/0045548 | A1 | 4/2002 | Saito | |
| 2002/0089580 | A1 | 7/2002 | Suzuki et al. | |
| 2002/0183203 | A1 | 12/2002 | Hoefs et al. | |
| 2003/0003399 | A1 | 1/2003 | Muller et al. | |
| 2004/0239720 | A1 * | 12/2004 | Clarke et al. | 347/37 |

FOREIGN PATENT DOCUMENTS

EP 716135 B1 9/1999

OTHER PUBLICATIONS

Chapter 11 of a Tutorial entitled "Actuators", pp. 1 through 41, taken from the website at http://www.consult-g2.com/course/chapter11/chapter.html, dated Apr. 22, 2003.

(Continued)

*Primary Examiner*—Stephen D Meier
*Assistant Examiner*—Rene Garcia, Jr.

(57) ABSTRACT

A printer comprises an arm mounted on a pivot member. The arm has a first portion adapted to move along an arcuate path. A drive motor rotates the arm about the pivot member. An electromagnetic radiation emitter mounted on the first portion is adapted to emit pulses onto an electromagnetic radiation-sensitive medium.

24 Claims, 7 Drawing Sheets

OTHER PUBLICATIONS

The Third-Generation HP Thermal Ink Jet Printhead by J. Stephen Aden, et al., Feb. 1994, Hewlett-Packard Journal, pp. 41-45.

Thermal Injet.Review, or How Do Dots Get from the Pen to the Page? by James P. Shields, Aug. 1992, Hewlett-Packard Journal, pp. 67-68.

Development of a High-Resolution Thermal Inkjet Printhead by William A. Buskirk et al. Oct. 1998, Hewlett-Packard Journal, pp. 55-86.

Hewlett-Packard Journal, May 1985, vol. 36, No. 5, pp. 1-27.

Optical Storage Technology—The Mini Disc, http://www.minidisc.org/keep/taiwan_minidisc_course.pdf printed Sep. 29, 2004.

Audio Compact Disk—An Introduction EE 498 by Professor Kelin J. Kuhn; http://www.ee.washington.edu/counselec/CE/kuhn/cdaudio/95x6.htm.

ECE 202—Introduction To Electrical Engineering, pp. 1-8; http://www.ece.northwestern.edu/~butz/202/lab1/lab1.html.

International Search Report for Application No. PCT/US2005/032914 based on U.S. Appl. No. 10/963,297. Report issued Feb. 10, 2006.

* cited by examiner

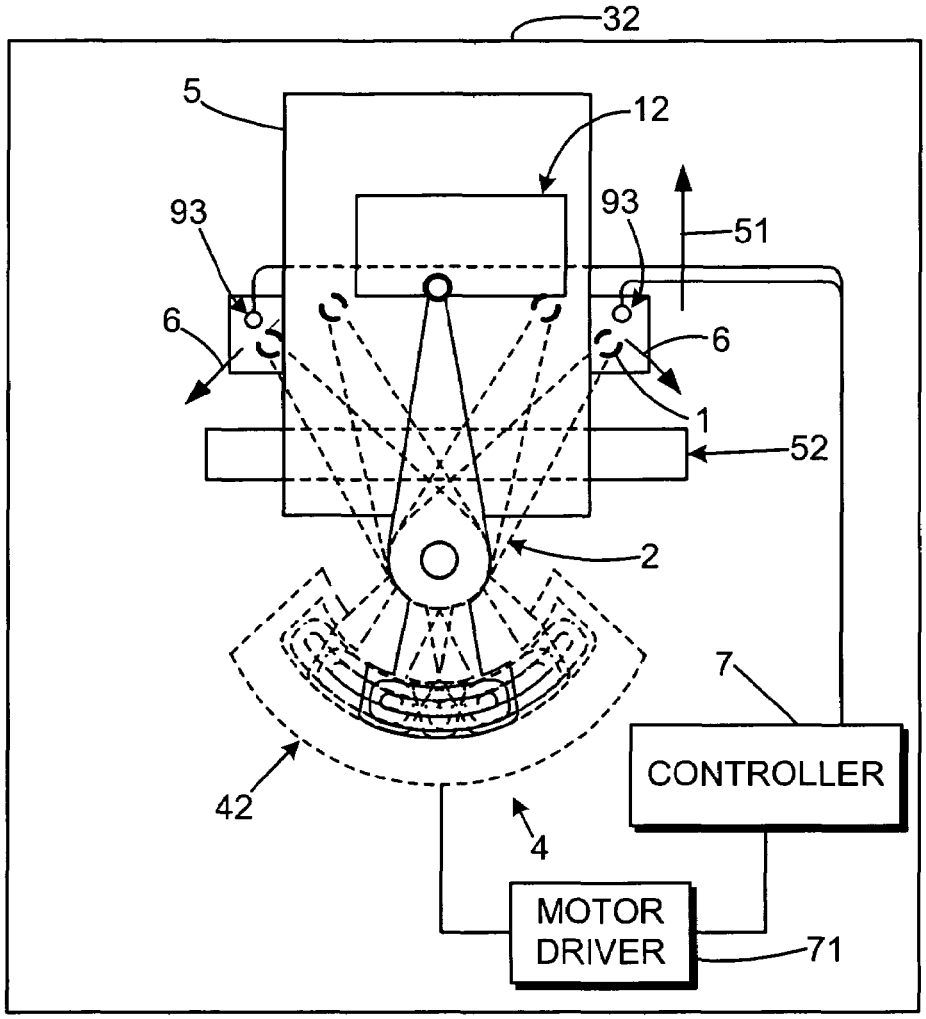
FIG. 2
FIG. 3
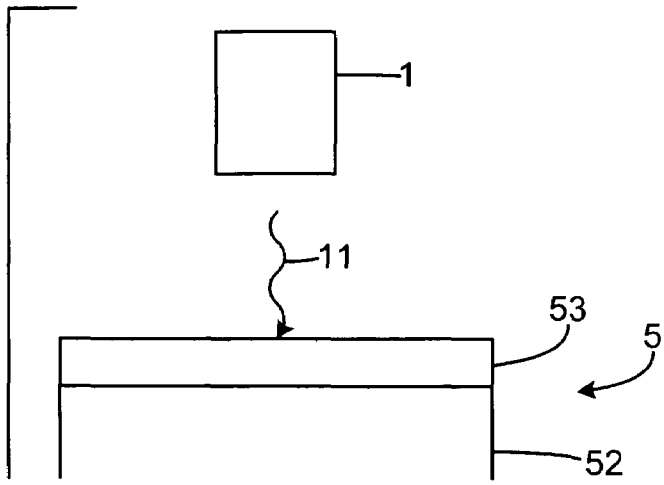

PRINTING APPARATUS AND METHOD

RELATED APPLICATIONS

This application related to commonly assigned U.S. patent application Ser. No. 10/452,522, entitled Printhead Positioning Mechanism, which was filed on Jun. 2, 2003; Ser. No. 10/836,866, entitled Media Labeling System, filed Apr. 30, 2004; Ser. No. 10/351,188, entitled Compositions, Systems, and Methods for Imaging, filed Jan. 24, 2003; Ser. No. 10/732,047, entitled Enhancing Optical Density, filed Dec. 9, 2003.

BACKGROUND OF THE DISCLOSURE

Desktop printers and larger plotters typically use a rectilinear left and right positioning system to linearly move an ink jet print cartridge or print head left and right across the surface of a sheet of paper or other printing medium. The nature of and the complexity of rectilinear printing mechanisms, however, pose some drawbacks to miniaturization.

BRIEF DESCRIPTION OF THE DRAWINGS

Features and advantages of the disclosure will be readily appreciated by persons skilled in the art from the following detailed description of exemplary embodiments thereof, as illustrated in the accompanying drawings, in which:

FIG. 2 is a top view of an embodiment of a printer with a laser printhead positioning assembly which moves the laser printhead in an arcuate path.

FIG. 3 illustrates a cross-sectional view of an exemplary embodiment of an electromagnetic radiation-sensitive printing medium.

DETAILED DESCRIPTION OF THE DISCLOSURE

Figure 1:
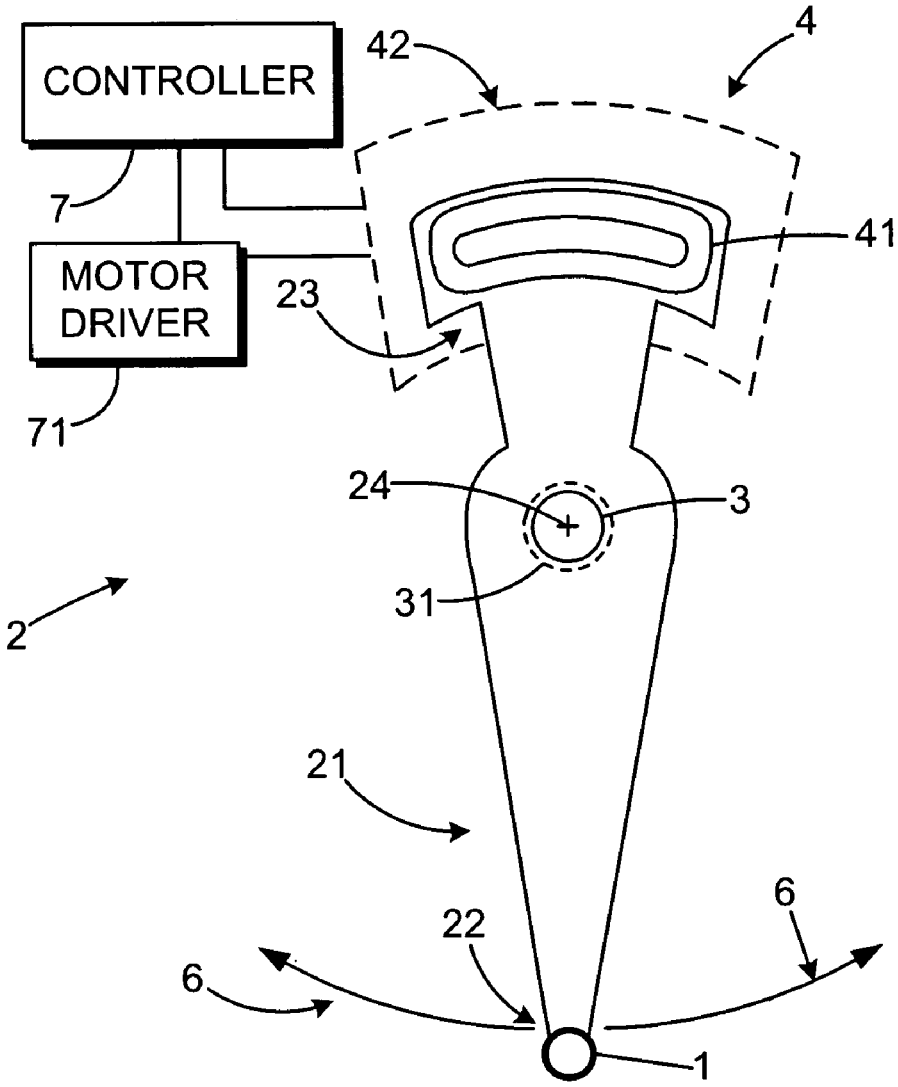
FIG. 1 is a top view of an embodiment of a laser printhead positioning assembly which moves the laser printhead in an arcuate path.

In the following detailed description and in the several figures of the drawing, like elements are identified with like reference numerals.

FIG. 1 illustrates an exemplary embodiment of a printer having an emitter 1 for emitting electromagnetic radiation onto a print medium 5 (FIG. 3). The print medium is sensitive to the electromagnetic radiation. The emitter 1 is mounted on an actuator arm 2. A drive motor 4 rotates the arm 2 about a pivot member 3 to move the emitter 1 over the medium 5 in a generally arcuate path 6. A controller 7 causes the emitter 1 to emit radiation onto the medium 5 at desired locations, in desired sizes and density to create spots which form an image 12 (FIG. 2) on the medium 5.

Figure 1A:
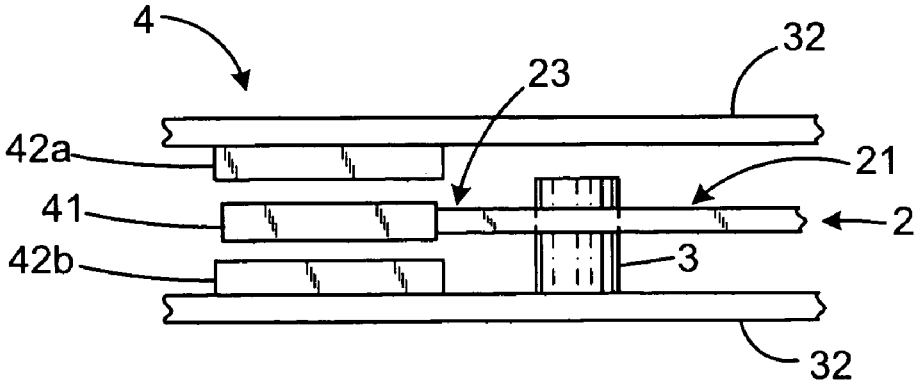
FIG. 1A is a side view of a portion of an embodiment of a laser printhead positioning assembly.

In the exemplary embodiment of FIG. 1, the actuator arm has a first portion 21 and a second portion 23 disposed on opposite sides of the pivot member 3. In an exemplary embodiment, the pivot member may be mounted or supported on a frame or housing 32 (FIG. 1A). The emitter 1 is mounted, at least in part, on the first portion 21 of the actuator arm 2 and may be mounted at a distal end 22 of the first portion 21 of the actuator arm 2. The pivot member may include a pivot bearing 31. The pivot member is centered at a pivot point 24 of the actuator arm. A drive motor 4 rotates the actuator arm about the pivot member 3 and the pivot point 24. In an exemplary embodiment, the drive motor 4 rotates the arm through an arc and reciprocates, moving the arm back and forth along the arc. The pivot point may be selected for a particular embodiment based on factors, including, arm reach and arm distances/speeds desired or needed for a given application.

In an exemplary embodiment, the drive motor 4 may be a voice coil motor. In one embodiment, the voice coil motor includes a movable voice coil 41 mounted on the second portion 23 of the actuator arm 2. The voice coil motor 4 may also have two permanent magnets 42*a* and 42*b* (FIG. 1A) which may be mounted in spaced relation with one above and one below the arcuate path of the voice coil 41 on the actuator arm 2. The voice coil and actuator arm move between the magnets. The two magnets 42*a*, 42*b* may be mounted on the frame or housing 32 for the printer.

Drive signals are applied to the motor 4 from a motor driver 71, controlled by a controller 7. In some exemplary embodiments, the controller 7 and motor driver 71 may be fabricated in a single circuit. The drive signals may be applied to the motor 4 via a wiring connection between the motor driver 71 and the coil 41. In response to the drive signals, an electromotive force is applied to the voice coil 41, causing movement of the actuator arm 2 in an arcuate or rotational path about the pivot 24, in a movement path determined by the motor drive signals. The movement of the arm 2 is illustrated in FIG. 2.

In an exemplary alternate embodiment, a magnet may be mounted on the second portion 23 of the actuator arm 2. In this embodiment, voice coils 41 could be mounted one above and one below the magnet, the magnet being able to move freely between the voice coils. In the alternate embodiment, the stationary voice coils may be mounted on a frame or housing 32 for the printer.

Voice coil motors have been developed for use, for example, to position read/write transducers in magnetic hard disk drives. Voice coil motors similar to those developed for use in magnetic hard disk drives may be suitable for use as the motor 4 of the laser positioning mechanism of FIG. 1. Voice coil motors used in disk drive applications are described, for example, in U.S. Pat. No. 5,305,169. Other drive motors may also be suitable for use as the motor 4 of a laser positioning mechanism including, for example, stepper motors. Thermal drift compensation may be employed in some embodiments to compensate for position drift due to temperature change.

In an exemplary embodiment, the emitter 1 includes a device configured to produce electromagnetic radiation directed at the print medium 5. In an exemplary embodiment, the emitter 1 includes a source of electromagnetic radiation, such as a laser. In exemplary embodiments, the emitter may include a laser and an optical path for directing electromagnetic radiation from the laser toward the medium 5. The optical path may include, for example, fiber optics, mirrors, beam splitters, lenses and/or other components. In an exemplary embodiment, the controller 7 controls the timing, energy and duration of the electromagnetic radiation emissions from the emitter 1 and controls the focus of the emitted beam or pulse on the medium 5 to create spots of a desired size, shape, appearance and location. In an exemplary embodiment, the emitter 1 may be an optical pickup unit which includes integrally fabricated focus sensors, focus motor (such as a voice coil actuator) and optics which are controlled by the controller to generate the electromagnetic radiation, adjust the focus of the radiation on the medium and to sense and control the proper focus and operation of the printer.

Commonly assigned patent application Ser. No. 10/732047, for example, discusses exemplary embodiments for focusing spots of electromagnetic radiation on print media. In an exemplary embodiment, the focus is adjusted responsive to feedback generated by a sensor.

In an exemplary embodiment, the electromagnetic radiation emitter 1 is a diode laser, for example a 780 nm laser. In further embodiments, the electromagnetic radiation emitter 1 may include a semiconductor or dye laser and may generate electromagnetic radiation with wavelengths of, for example, 248 nm, 266 nm, 308 nm, 355 nm, 512 nm, 808 nm or 1064 nm. In an exemplary embodiment, the laser may be a carbon dioxide laser at 9.8 um or 10.6 um. In other embodiments, the electromagnetic radiation emitter may include a microwave emitter, IR emitter or UV emitter.

FIG. 2 illustrates an exemplary embodiment of a printer with a voice coil motor 4 for driving an actuator arm 2 to position an electromagnetic radiation emitter 1, the electromagnetic radiation emitter 1 being moved in an arcuate path over a printing medium 5. In an exemplary embodiment, the controller generates control signals for causing the electromagnetic radiation emitter to direct pulses of electromagnetic radiation onto the printing medium 5 to create spots which combine to form an image 12. In an exemplary embodiment, the printer may include a frame or housing 32.

In an exemplary embodiment, the spots are areas on the medium having a reflectivity that is different from the reflectivity of unexposed portions of the medium 5. In an exemplary embodiment, the spots are visible to human viewers when exposed to light. In other embodiments, the spots may be detectible upon exposure to electromagnetic radiation in visible or non-visible wavelengths.

In exemplary embodiments, the spots may are color differences, grey scale differences, black and white variations or other variations detectable by the human visual system or other detection mechanism. In an exemplary embodiment, a controller controls the emitter 1 to emit pulses onto the medium 5. The controller controls the emitter or other electromagnetic radiation source to direct light onto the medium at specific locations to create spots to form desired text, pictures, images or other optically or otherwise detectable forms. In one exemplary embodiment, the spots are visible areas which may be dark or colored. In another exemplary embodiment, the spots are not visible, but may be detectible by exposure to infra-red or ultra-violet radiation or by other means. In an exemplary embodiment, the appearance or means of detecting the spots may depend on the frequency of operation of the electromagnetic radiation source and emitter and the medium on which the image is being created.

In an exemplary embodiment, the spots may include lines, dots, oblong spots or circular areas. The size and shape of the optically detectible areas may depend on a variety of factors, including: the focus, frequency, intensity and duration of the emitted pulses incident on the printing medium; the sensitivity of the medium to electromagnetic radiation; and the speed and direction of translation of the laser mounted on the actuator arm at the period of time during which the laser is pulsed. In an exemplary embodiment, the controller generates control signals to control the electromagnetic source and emitter to create spots of a desired size in desired locations on the printing medium. In an exemplary embodiment, the controller may adjust system parameters, in part, in response to the particular medium being printed. In an exemplary embodiment, the controller may be coupled to a sensor which senses a marker on the medium and automatically adjusts system parameters responsive to the marker sensed by the sensor.

FIG. 3 illustrates a simplified cross-section of an exemplary embodiment of a print medium 5. The emitter 1 directs a pulse 11 or pulses onto a surface of an electromagnetic radiation-sensitive printing medium 5 to form visible spots. In the embodiment of FIG. 3, the print medium 5 may include a substrate 52, for example paper, which has been treated with an image-forming coating 53. In an exemplary embodiment, the coating 53 is a single layer incorporating all components. In an exemplary embodiment, the image-forming coating may be a color forming coating which includes a color former, for example a fluoran dye, an activator, such as a phenol, and an "antenna" for energy absorption, such as indocyanine green. In an exemplary embodiment, the color-forming coating is applied to the medium by a suitable method. Suitable methods may include, for example, silk screen printing, spray coating, roller coating, vapor deposition, spin coating, electrostatic deposition and powder coating. Commonly assigned and related application Ser. No. 10/351188, for example, discloses exemplary printing media 5 and exemplary color-forming coating 53.

In an exemplary embodiment, exposing the color-forming coating to electromagnetic radiation creates an optically detectible area or spot 8, roughly in the shape and size of the laser beam that impacts the surface of the medium 5. In an exemplary embodiment, the printing medium 5 may produce spots 8 upon exposure to a 35 mW, 780 nm laser for less than 100 usec. In an exemplary embodiment, the spots have a size of about 1 to 20 um in one dimension and 1 to 100 um in another dimension. In exemplary embodiments, the spots may include curved, swept sections or a series of dots or oblong shapes or other regular or irregular shapes which may depend, at least in part, on the movement of the arm during the time that the electromagnetic radiation is emitted onto the medium.

In exemplary embodiments, the printing medium 5 may be in the form of labels, transparencies or other media suitable for use in a printer. In further exemplary embodiments, the medium 5 may be a medium which is sensitive to electromagnetic radiation emitted by an electromagnetic radiation source or any medium treated with color-forming dye, for example plastic, polymer, metal, wood or cardboard.

In an exemplary embodiment, the light-sensitive medium 5 is sensitive to light at the frequency and intensity of pulses emitted by the electromagnetic radiation source and emitter 1. In an exemplary embodiment, the medium 5 is made from material that reacts with emitted electromagnetic radiation to form spots. In further exemplary embodiments, the medium may be a medium that is susceptible to marking by burning, oxidization, heat, discoloration and/or annealing by electromagnetic radiation, for example laser energy, emitted by a source.

Figure 4A:
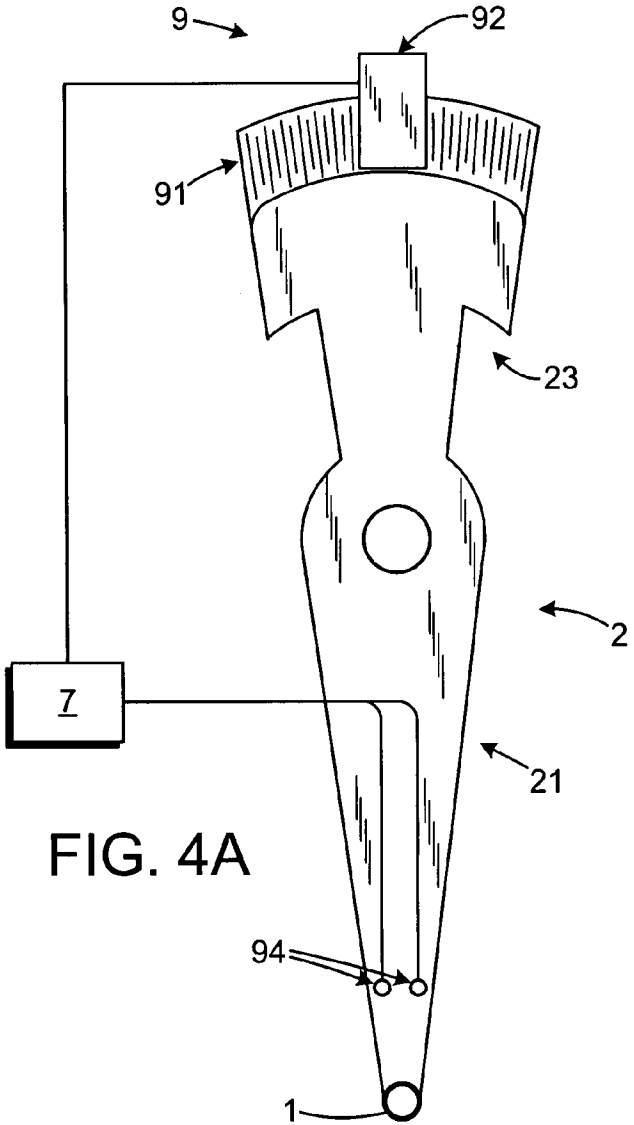
FIG. 4A is a bottom view of an embodiment of an actuator arm with a laser printhead.
Figure 4:
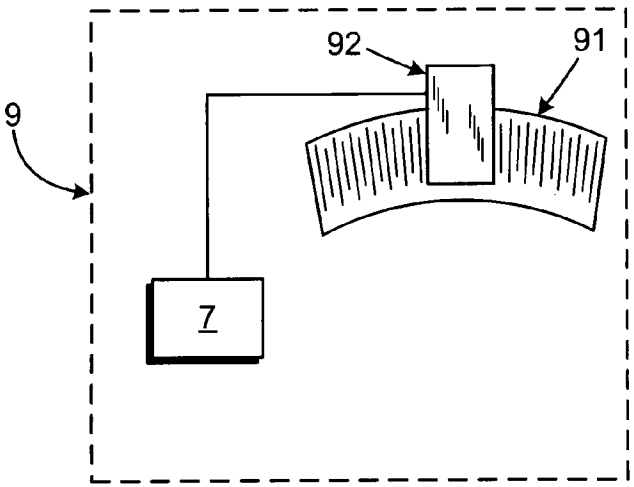
FIG. 4 illustrates an embodiment of a position detection system for a laser printhead positioning unit.

FIGS. 4 and 4A illustrate a radial position detection system 9. In an exemplary embodiment, the radial position of the arm and the electromagnetic radiation emitter is sensed by the position detection system 9. The position detection system 9 may include a "closed loop" position detection system with a radial segment encoder 91, which may be an optical encoder, and an encoder pickup 92. The radial segment encoder may be mounted on the actuator arm adjacent the voice coil. A radial segment encoder may be mounted at the end of the actuator arm or close to the pivot. The encoder pickup may be mounted on the frame or housing 32 (FIG. 2). In an alternative embodiment, a radial segment encoder could be mounted on the frame or housing, with the encoder pickup mounted on the actuator arm.

The position detection system 9 may also include or alternatively include an "open loop" position detector with an end of travel detector 93 (FIG. 2) at one or both opposite ends of travel. In the case of an "open loop" position detector, an end of travel detector 93 determines the position of the laser or the actuator arm when it reaches the position at the end of its travel. The controller determines the position of the laser or actuator arm when it is not at the end of travel by calculating the angular distance traveled from the end of travel. An end of travel detector may, for example, include a photo interrupter (for example, with an emitter/detector pair), Hall effect proximity sensors or magnetic effect sensors.

The position detection system provides position information to the controller 7 which may be used by the controller in generating control signals for the voice-coil motor to position the actuator arm and for the electromagnetic radiation emitter to control the image-wise emission of electromagnetic pulses.

In an exemplary embodiment, the positioning accuracy achievable by a voice coil motor enables a radial printer to perform accurate image printing right up to the edges of a print medium. The high slew rates of the swing arm system may permit the printer to be set for multiple pass printing without significantly delayed print output.

The printing accuracy may be further enhanced through use of a print medium edge detector or print medium edge sensor 94 (FIG. 4A). One factor which may limit the accuracy of printing is an uncertainty in the location of the edge of a print medium. The controller may control the laser based on the position of the laser relative to the print medium as determined, at least in part, by the position sensing system 9 and the expected location of the print medium with respect to the print head. However, the actual location of the edge of the print medium may deviate from the expected location of the edge of the print medium due, in part, to uncertainties caused by manufacturing and operational tolerances of the printer and the positioning system and or print medium transport mechanism and/or the flexibility or non-rigidity of various print media.

A print medium detector may include, for example, at least one of a photoelectric sensor (through-beam or reflective), a laser sensor, surface-mount technology (SMT) IR device, and/or an emitter/detector pair—one mounted on the actuator arm and the opposite pair partner on the opposed side of the edge of the print medium. Other suitable print medium detectors may alternatively be employed. In an exemplary embodiment, the print medium detector includes a photo detector fabricated together with a laser as part of an optical pickup unit.

A print medium edge detector 94 may be located on the actuator arm to detect the actual relative location of the laser with respect to the edge of the print medium (FIG. 2). This information is relayed to the controller 7. The controller 7 may use this information, in part, to control the electromagnetic radiation emitter 1 to emit light pulses to create the image on a print medium. Detecting the actual position of the edge of the print medium with respect to the laser may improve printing accuracy.

Figure 5:
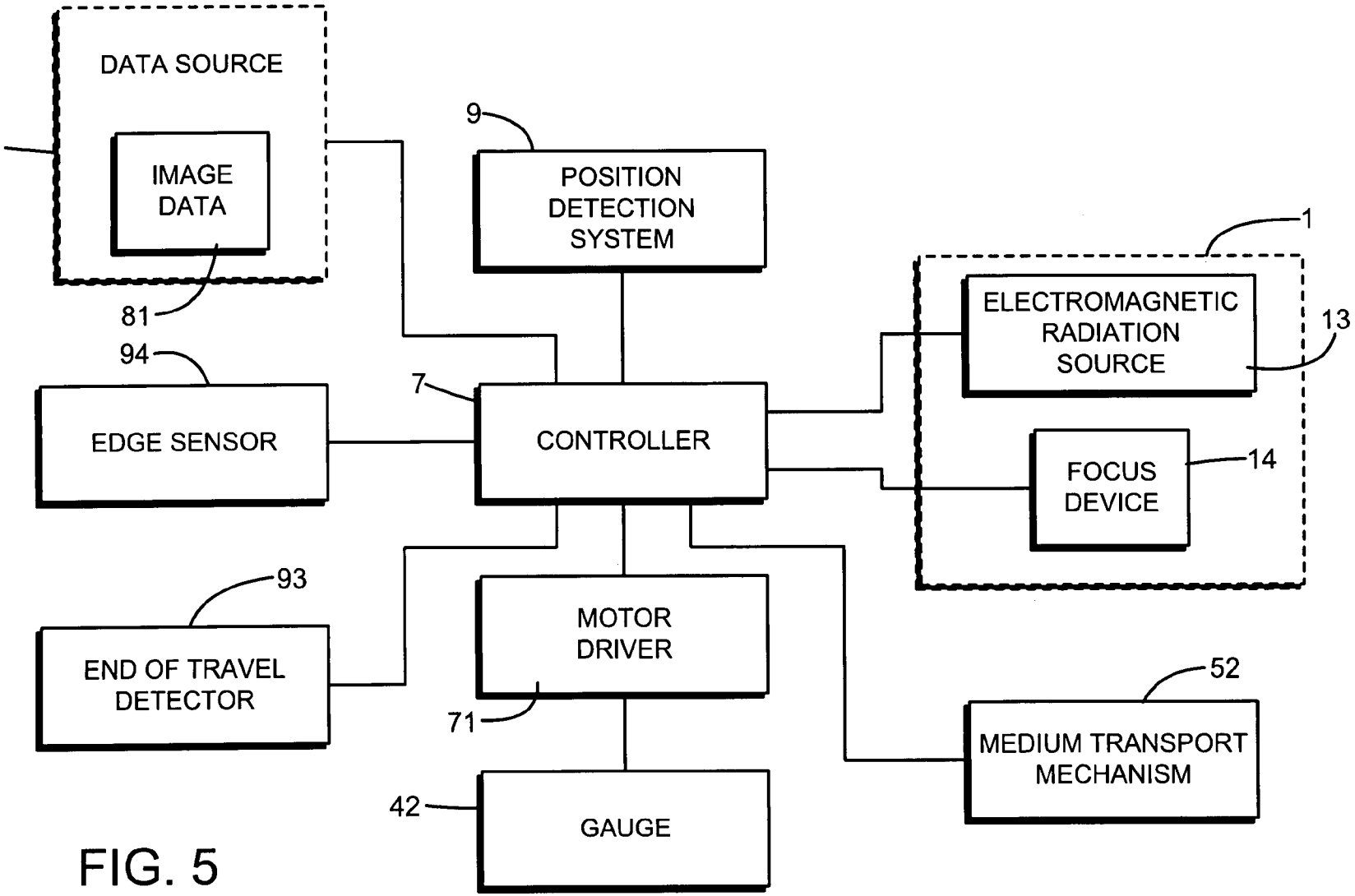
FIG. 5 illustrates an exemplary embodiment of a printer control system.

FIG. 5 illustrates an exemplary embodiment of the control relationship among the controller 7 and various other features of a printer. An exemplary embodiment has a data source 8, which may be memory, a host computer, digital camera, data stream or other source. In an exemplary embodiment, the data source 8 provides image data 81 to the controller 7. In an exemplary embodiment, the controller 7, which may include a microcomputer, ASIC or other device, generates control signals for the motor 4 and the electromagnetic radiation emitter 1.

In an exemplary embodiment, the electromagnetic radiation emitter 1 generates a pulse or pulses of electromagnetic radiation responsive to control signals and directs the pulse or pulses onto a surface of a printing medium 5. In an exemplary embodiment, the printing medium 5 is sensitive to electromagnetic radiation such that exposure to an emitted pulse of electromagnetic radiation creates a spot on the medium 5. In an exemplary embodiment, the control signals are generated responsive to image data 81 from data source 8 and responsive to emitter position data from the position detection system 9 to cause pulses to be emitted onto the medium 5 at desired times with desired intensity and duration so that the collection of spots formed on the medium combine to form an image corresponding to image data 81.

In an exemplary embodiment, the controller operates to turn the electromagnetic radiation source 13 of the emitter 1 on or off as required to produce spots in desired locations on the print medium. In an exemplary embodiment, the controller 7 turns the electromagnetic radiation source 13 on and off responsive to image data stored in memory or provided by an external data source 8. In an exemplary embodiment, controller controls the electromagnetic radiation emitter 1 by sending control signals to a focus device 14 for focusing the laser, by adjusting the power of the electromagnetic radiation source 13, and by controlling the motor driver 71 and voice coil 41 to adjust the speed and position of the arcuate motion of the actuator. In an exemplary embodiment, the controller generates control signals responsive to an edge sensor 94 and/or an end of travel detector 93. In an exemplary embodiment, the controller generates control signals for the medium transport mechanism 52. In an exemplary embodiment, the controller dynamically focuses the laser, in part, responsive to printer driver software. In an exemplary embodiment, printer driver software may run on the controller.

In an exemplary embodiment, the time required to form an image on a print medium may depend on the size of the spots, or "spot dimension," as determined, at least in part, by the control of the focus, the power, relative velocity of the electromagnetic radiation emitter across the surface of the print medium, the size of the image, the vertical print density and the sensitivity of the medium. In an exemplary embodiment, the sensitivity of the medium may be determined by adjusting various parameters such as coating thickness, concentration of radiation absorber, and transition temperatures and energy of color reaction.

In an exemplary embodiment, the electromagnetic radiation source has a laser with a pulse width of 70 nanoseconds in a continuously on mode. In one exemplary embodiment, the controller controls the electromagnetic radiation source with an on/off cycle of about 1 usec to 1000 usec to create optically detectible areas in the medium. In another exemplary embodiment, the on/off cycle is, for example, from about 10 usec to about 80 usec.

In one exemplary embodiment, the focus spot dimensions containing 90% of the energy envelope are between 1 um to 1000 um. In another exemplary embodiment, the spot dimension is, for example, between 10 um and 50 um and may be between 19 to 20 um representing a line width of about 20 um, roughly corresponding to 2400 dots per inch (dpi).

In an exemplary embodiment, the writing speed may be determined primarily by the energy delivered or emitted by the electromagnetic radiation emitter. In an exemplary embodiment, the energy delivered is between 1 mJ to 2000 mJ/cm2, for example between 100 mJ to 200 mJ/cm2. In one exemplary embodiment, a laser of 35 mw power output has a linear speed between 1 cm/sec to 500 cm/sec. In another exemplary embodiment, the linear speed may be from 10 cm to 500 cm/sec, or from 100 to 400 cm/sec.

In an exemplary embodiment, the printing speed may be exponentially proportional to the power of the laser, and faster speeds are generally more preferred. Using these settings, a laser with a 35 mw power output, linear speed of 50 cm/sec and assuming a vertical print density of 2400 dpi, an area of approximately 1 in×1 in (2.5 cm×2.5 cm) requires about 2 min for registering an image. Using a laser of 100 mw power output, however, the same area at the same print density can be printed in about 12 seconds. In an exemplary embodiment, a printer may include multiple emitters or sources, which may reduce the printing time by a an amount generally proportional to the number of emitters or sources used. In addition, decreasing the vertical print density may also decrease the printing time.

A printer may experience positioning errors which may be dependent upon the tolerances in the positioning mechanism. In an exemplary embodiment, positioning errors may be corrected by an error correction read/write algorithm where a sensor detects the last few spots written and repositions itself at regular intervals.

In an exemplary embodiment, the laser can emit pulses from positions along the generally arcuate path 6. The print medium 5, however, may be larger (i.e., wider) than the area covered by the path of the laser. FIG. 2 illustrates a printer with a print medium transport mechanism 52 to move the print medium 5 in a print medium advance direction 51 adjacent the area of the arcuate path 6 described by the laser so that the image 12 can be formed on successive portions of the print medium as the medium 5 is advanced along the advance direction 51.

Figure 6:
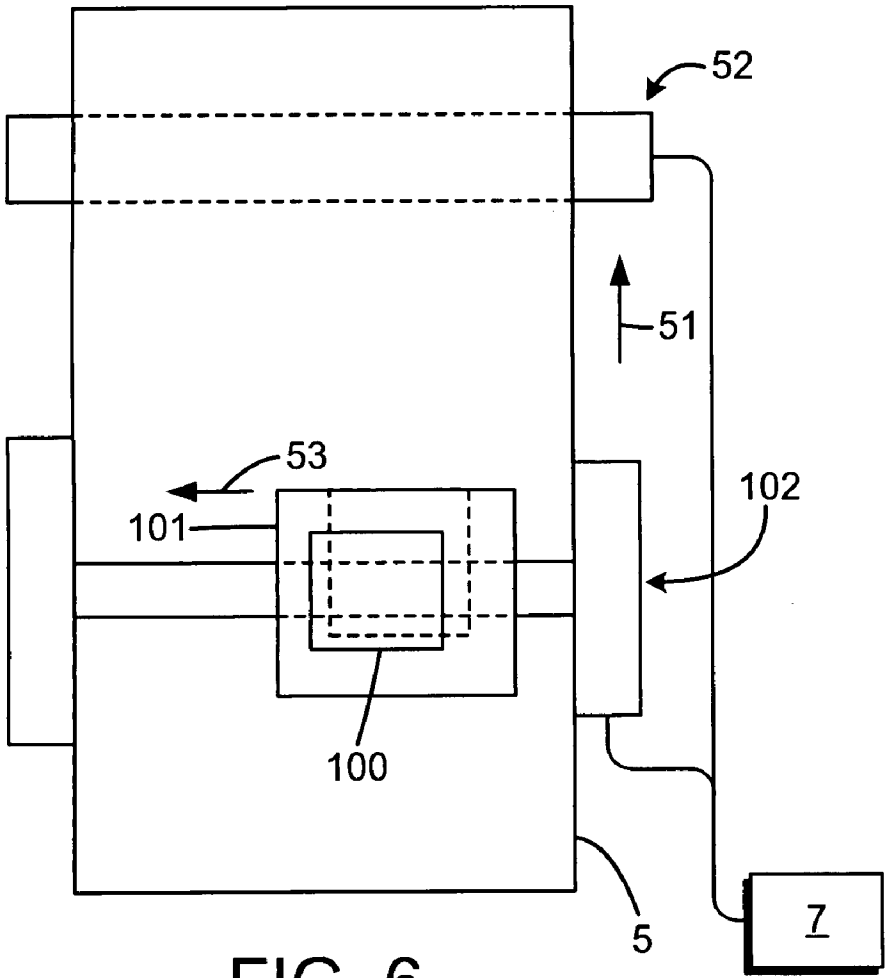
FIG. 6 illustrates an exemplary embodiment of a laser printhead positioning unit mounted on a carriage.

In other embodiments, the electromagnetic radiation emitter 1, the drive motor 4 and the actuator arm 2 may be mounted together as a positioning unit 100 on a carriage 101 (FIG. 6). A carriage drive may move the carriage, with the emitter 1, the drive motor and the actuator arm, over the surface of a print medium. FIG. 6 illustrates an exemplary embodiment of an electromagnetic radiation emitter positioning unit 100 mounted on a carriage 101. The carriage drive 102 moves the carriage 101 and the unit 100 across the surface of the print medium 5 along a swath axis 53. A print medium transport mechanism 52 may be used in conjunction with the carriage 101 and carriage drive 102 to move the print medium in a print medium direction 51. In a larger, conventional-style printer, a laser positioning unit 100 may be mounted on a carriage in the location where a print cartridge, for example an ink-jet printhead, would conventionally be located. As the laser positioning unit is moved across the print medium, the actuator arm moves the laser back and forth resulting in a large print swath.

Figure 7:
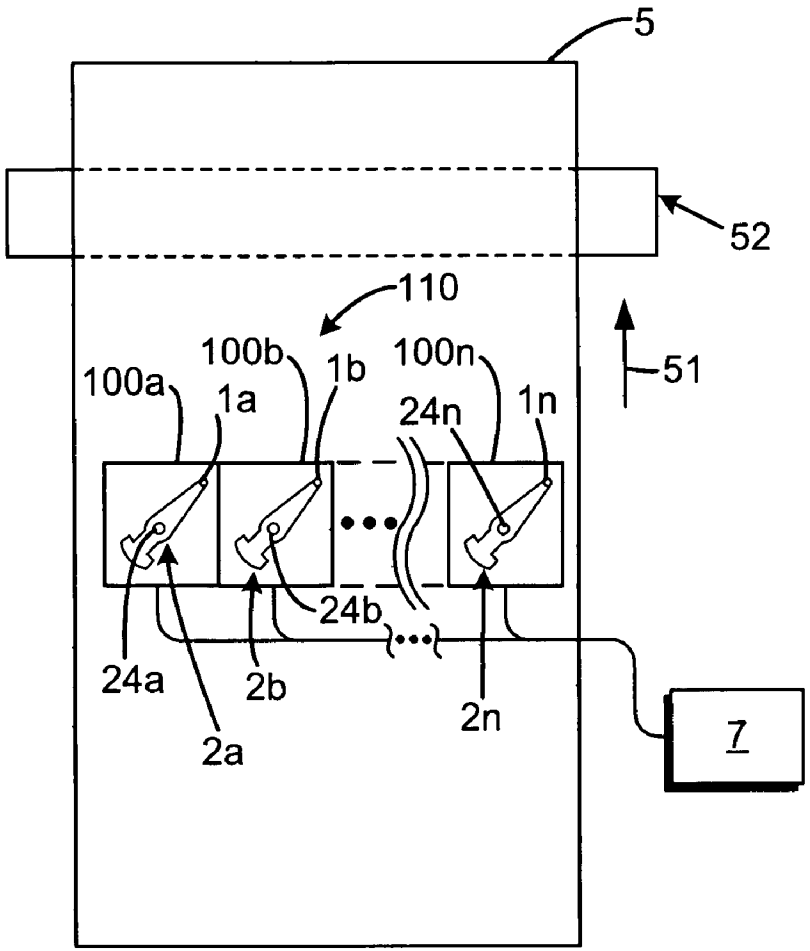
FIG. 7 illustrates an exemplary embodiment of an array of laser printhead positioning units.

In certain embodiments, an array 110 (FIG. 7) of laser positioning units 100*a*-100*n* may be used to print images in sizes larger than the size achievable by one printer unit alone. FIG. 7 illustrates an exemplary embodiment of an array 110 of laser positioning units 100*a*-100*n*. The array may include a plurality of individual laser positioning units 100*a*, 100*b* . . . 100*n* sufficient to form an image consistent with images produced by a standard-sized printer, a large format printer or plotter or any desired size. The respective units include arms 2*a* . . . 2*n* mounted for pivoting movement about pivots 24*a* . . . 24*n*, each having a electromagnetic radiation emitter 1*a* . . . 1*n* mounted thereon for movement about an arcuate path. A printer may include at least a first arm 2*a* and a second arm 2*b*, the first arm having a first laser mounted thereon and the second arm having a second laser mounted thereon. The arms 2*a*, 2*b* are configured to rotate about a first axis 24*a* and a second axis 24*b* respectively.

Each printer mechanism 100*a*-100*n* is controlled by a controller 7 to create an image in accordance with image data. The image is created on a print medium 5. The print medium 5 may be transported past the array by a print medium transport mechanism 52. In the alternative, the array could be transported over the print medium by an array carriage similar to the carriage 101 (FIG. 6). An array carriage could be used in conjunction with a print medium transport mechanism 52.

An exemplary method of manufacturing a printer includes providing an arm mounted on a pivot member. In an exemplary embodiment, the pivot member may have a first portion adapted to move along a limited arcuate path. An exemplary embodiment of manufacturing a printer may also include providing a drive motor for rotating the arm about the pivot member. In an exemplary embodiment, the drive motor may be a voice coil motor. In an exemplary embodiment, a method of manufacturing a printer includes mounting an electromagnetic radiation emitter on the first portion of the arm. In an exemplary embodiment, the emitter is adapted to emit pulses onto an electromagnetic radiation-sensitive medium. The emitter may be, for example, a laser.

Figure 8:
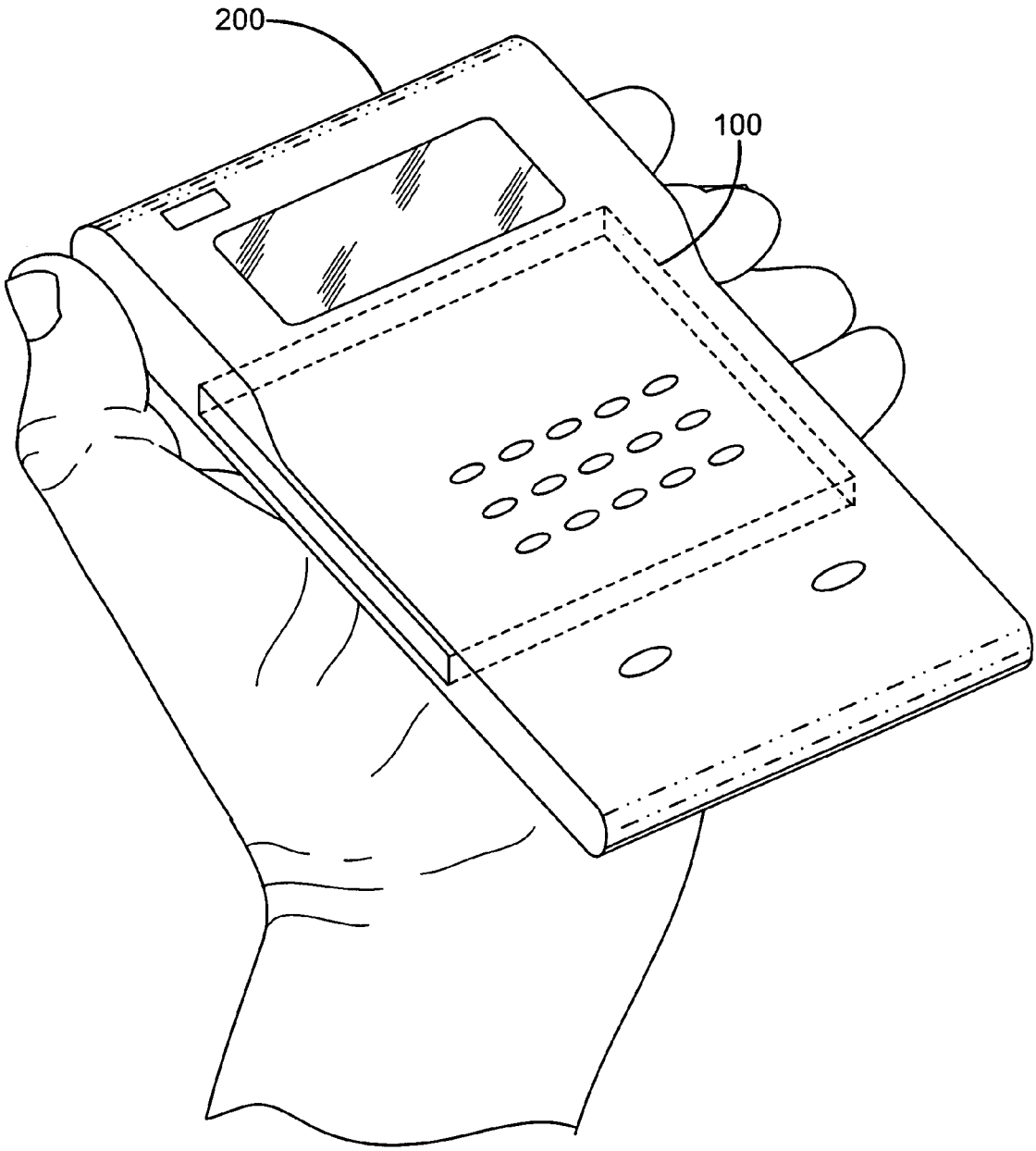
FIG. 8 illustrates an exemplary embodiment of a handheld device having a printer.
Figure 9:
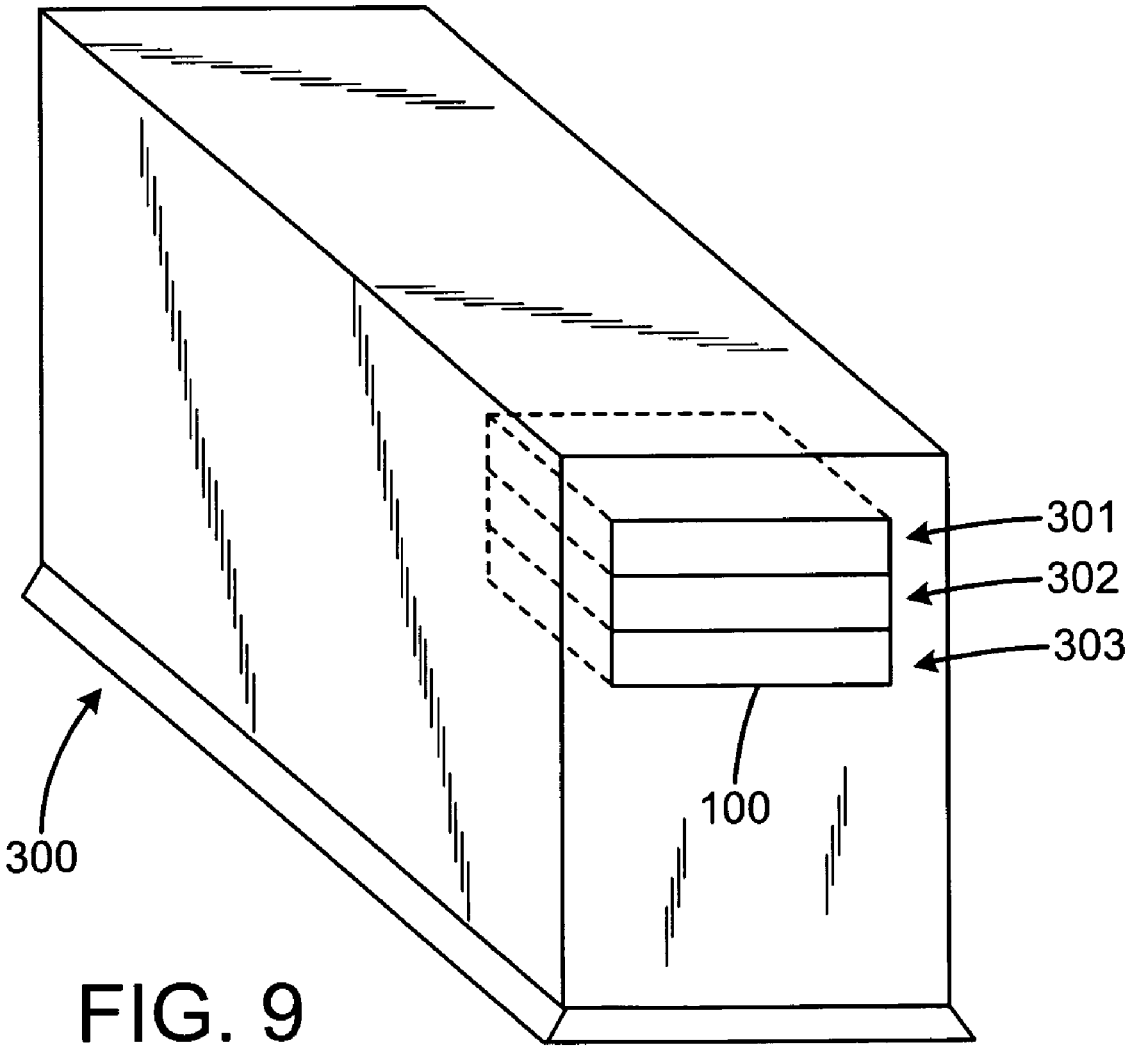
FIG. 9 shows an embodiment of a computer with a printer installed in a hardware bay.

A printer with a voice coil motor to drive an actuator arm can be manufactured with sizes similar to the size of hard disk drives, including micro-hard disk drives. Printers which are designed and manufactured with a size on the order of the size of a hard disk drive are suitable for use with and may be incorporated into small devices. FIG. 8 illustrates an exemplary embodiment of a printer 100 incorporated into a portable device 200 such as a hand-held computing device, for example personal digital assistants (PDA's), handheld computers, digital cameras, telephones, for example cellular telephones, or other battery powered, portable devices. The printer 100 may also be suitable for integration into the hard drive or hardware bays of a portable computer, or otherwise into the housing of a personal computer. FIG. 9 illustrates a computer 300 with three hardware bays 301, 302 and 303. A computer may have, for example, an optical disk drive installed in hardware bay 301, a magnetic disk drive in hardware bay 302 and a printer having one or more units 100 in hardware bay 303. In one embodiment, the medium 5 to be printed may be inserted into printer 100 of portable device 200 or computer 300 by the user and then removed after printing has been performed.

Voice coil motors can drive actuator arm-mounted lasers at speeds such that the printer may achieve higher print rates than conventional rectilinear print mechanisms. An exemplary embodiment of a printer with a laser printhead mounted on an actuator arm and driven by a voice coil motor may operate with higher efficiency than conventional rectilinear print mechanisms. A voice coil, electromagnetic radiation-sensitive printer allows a small, inexpensive, direct drive to move very rapidly across the surface of a print medium. A printer with a voice coil motor and arm mechanism with a size similar to a two-inch disk drive mechanism, for example, can move an electromagnetic radiation emitter across its maximum range of movement in about 10 milliseconds with a high degree of positional accuracy.

An embodiment of a printer with a laser positioning system as described above may be very small, very fast, and operable at low cost. The printer can translate an actuator arm with a very small print head attached to it at very high access speeds due to the low mass of the arm and laser. The print head and actuator arm have low swept mass which leads to reduced acceleration/deceleration distances.

The printing speed may depend on several factors, including: the swath distance (distance of a single pass of the laser over the print medium), the linear speed of the laser, the vertical print density and the time needed to reverse the laser at the end of each swath.

It is understood that the above-described embodiments are merely illustrative of the possible specific embodiments which may represent principles of the present invention. Other arrangements may readily be devised in accordance with these principles by those skilled in the art without departing from the scope and spirit of the invention.

What is claimed is:

1. A printer comprising:

an arm mounted on a pivot member and having a first portion adapted to move along an arcuate path;

a drive motor for rotating the arm about the pivot member;

an electromagnetic radiation emitter mounted on the first portion and adapted to emit pulses onto an electromagnetic radiation-sensitive medium, said electromagnetic radiation emitter including a laser; and, a position detection system for generating position information responsive to a position of the electromagnetic radiation emitter, wherein the position detection system includes a radial segment encoder that is mounted on the arm.

2. The printer according to claim 1, wherein the drive motor is a voice coil motor.

3. The printer according to claim 2, wherein the voice coil motor includes a voice coil mounted on the arm.

4. The printer according to claim 1, wherein the position detection system comprises an end of travel detector.

5. A printer comprising:

an arm mounted on a pivot member and having a first portion adapted to move along an arcuate path;

a drive motor for rotating the arm about the pivot member;

an electromagnetic radiation emitter mounted on the first portion and adapted to emit pulses onto an electromagnetic radiation-sensitive medium; and a print medium edge detector for detecting a location of an edge of the print medium.

6. A printer comprising:

an arm mounted on a pivot member and having a first portion adapted to move along an arcuate path;

a drive motor for rotating the arm about the pivot member;

an electromagnetic radiation emitter mounted on the first portion and adapted to emit pulses onto an electromagnetic radiation-sensitive medium, said electromagnetic radiation emitter including a laser;

a controller for controlling the drive motor and the electromagnetic radiation emitter; and, a position detection system for generating position information responsive to a position of the electromagnetic radiation emitter, wherein the position detection system includes a radial segment encoder that is mounted on the arm.

7. The printer according to claim 6, wherein the drive motor is a voice coil motor.

8. The printer according to claim 7, wherein the voice coil motor includes a voice coil mounted on the arm.

9. The printer according to claim 6, wherein the controller controls the electromagnetic radiation emitter at least in part responsive to the position information.

10. The printer according to claim 6, wherein the position detection system comprises an end of travel detector.

11. The printer according to claim 6, wherein the controller controls the electromagnetic emitter at least in part responsive to image data.

12. The printer according to claim 6, wherein the electromagnetic radiation emitter comprises a 780 nm laser.

13. The printer according to claim 6, further comprising a frame, wherein the arm is pivotally coupled to the frame.

14. The printer according to claim 6, further comprising:

a print medium transport mechanism for transporting a print medium.

15. A printer comprising:

an arm mounted on a pivot member and having a first portion adapted to move along an arcuate path;

a drive motor for rotating the arm about the pivot member;

an electromagnetic radiation emitter mounted on the first portion and adapted to emit pulses onto an electromagnetic radiation-sensitive medium;

a controller for controlling the drive motor and the electromagnetic radiation emitter; and a print medium edge detector for detecting a location of an edge of a print medium.

16. The printer according to claim 15, wherein the controller controls the electromagnetic radiation emitter at least in part responsive to the print medium edge detector.

17. A printer comprising:

means for moving a laser printhead in an arcuate path;

means for controlling the laser printhead to transmit light onto a light-sensitive medium; and, means for detecting an edge of the medium.

18. The printer of claim 17, comprising:

means for moving the medium in a linear path.

19. A method of printing comprising:

reciprocating an electromagnetic radiation emitter along an arcuate path; and transmitting pulses from the electromagnetic radiation emitter onto an electromagnetic radiation-sensitive medium;

generating signals to control the electromagnetic radiation emitter to transmit light in response to image data;

detecting a position of the electromagnetic radiation emitter;

generating signals to control the electromagnetic radiation emitter in response to image data and in response to the position of the emitter; and, detecting a relative position of the electromagnetic radiation emitter with respect to an edge of the electromagnetic radiation-sensitive medium.

20. The method of printing, in accordance with claim 19, wherein the detecting the position of the emitter is performed with a radial segment encoder.

21. The method of printing, in accordance with claim 19, wherein detecting a position of the emitter is performed with an end of travel detector.

22. The method of printing, in accordance with claim 19, wherein the signals to control the laser printhead to transmit light are generated in further response to the relative position of the printhead with respect to the edge of the print medium.

23. The method of claim 19, comprising:

moving the medium in a linear path.

24. The method of claim 23, wherein the medium is moved linearly in-between reciprocations of the emitter.

* * * * *

UNITED STATES PATENT AND TRADEMARK OFFICE

CERTIFICATE OF CORRECTION

PATENT NO. : 7,377,617 B2
APPLICATION NO. : 10/963267
DATED : May 27, 2008
INVENTOR(S) : Leo C. Clarke et al.

It is certified that error appears in the above-identified patent and that said Letters Patent is hereby corrected as shown below:

On page 2, item (56), under "Other Publications", in column 2, line 7, delete "10/963,297" and insert -- 10/963,267 --, therefor.

In column 10, line 25, in Claim 14, after "transporting" delete "a" and insert -- the --, therefor.

Signed and Sealed this

Eighteenth Day of August, 2009

David J. Kappos

David J. Kappos
*Director of the United States Patent and Trademark Office*